US005529711A

United States Patent [19]

Brodbeck et al.

[11] Patent Number: 5,529,711

[45] **Date of Patent: *Jun. 25, 1996**

[54] PHASE STABLE, THICKENED AQUEOUS ABRASIVE BLEACHING CLEANSER

[75] Inventors: Kevin J. Brodbeck, Pleasanton; Aram Garabedian, Jr., Fremont; Brian P. Argo, Tracy; Amy M. Penticoff, San Francisco; Clement K. Choy, Alamo, all of Calif.

[73] Assignee: The Clorox Company, Oakland, Calif.

[ * ] Notice: The term of this patent shall not extend beyond the expiration date of Pat. No. 5,470,499.

[21] Appl. No.: 474,354

[22] Filed: Jun. 7, 1995

Related U.S. Application Data

[63] Continuation of Ser. No. 141,144, Oct. 22, 1993, abandoned, which is a continuation-in-part of Ser. No. 125,949, Sep. 23, 1993, Pat. No. 5,470,499.

[51] Int. Cl.[6] ..... C11D 3/395; C11D 3/14; C11D 1/75; C11D 9/20

[52] U.S. Cl. ..... 252/102; 252/98; 252/99; 252/173; 252/547; 252/165; 252/155; 252/97; 252/103; 252/174.23; 252/174.24; 252/174.14; 252/DIG. 1; 252/DIG. 2; 252/DIG. 14; 252/174.25; 252/160; 252/109; 252/110; 252/112; 252/113; 252/187.25

[58] Field of Search ..... 252/98, 99, 173, 252/547, 165, 155, 97, 102, 103, 174.23, 174.24, 174.14, DIG. 1, DIG. 2, DIG. 14, 174.21, 174.25, 145, 160, 187.26, 187.25, 187.24, 109, 110, 112, 113; 134/39, 40

[56] References Cited

U.S. PATENT DOCUMENTS

| | | | |
|---|---|---|---|
| 3,985,668 | 10/1976 | Hartman | 252/99 |
| 4,005,027 | 1/1977 | Hartman | 252/99 X |
| 4,051,056 | 9/1977 | Hartman | 252/99 |
| 4,240,919 | 12/1980 | Chapman | 252/99 X |
| 4,284,533 | 8/1981 | Imamura et al. | 252/174.25 X |
| 4,287,079 | 9/1981 | Robinson | 252/99 |
| 4,347,153 | 8/1982 | Hooper et al. | 252/174.25 |
| 4,352,678 | 10/1982 | Jones et al. | 252/99 X |
| 4,576,728 | 5/1986 | Stoddart | 252/102 |
| 4,599,186 | 7/1986 | Choy et al. | 252/174.25 X |
| 4,657,692 | 4/1987 | Choy et al. | 252/174.25 X |
| 4,695,394 | 9/1987 | Choy et al. | 252/174.25 X |
| 4,836,948 | 6/1989 | Corring | 252/174.25 X |
| 4,842,757 | 6/1989 | Reboa et al. | 252/174.25 X |
| 4,857,226 | 8/1989 | Drapier et al. | 252/174.25 |
| 4,950,416 | 8/1990 | Baxter | 252/174.25 X |
| 5,130,043 | 7/1992 | Prince et al. | 252/174.25 X |
| 5,185,096 | 2/1993 | Ahmed | 252/174.24 X |
| 5,202,046 | 4/1993 | Dixit et al. | 252/99 X |
| 5,205,953 | 4/1993 | Dixit | 252/99 X |
| 5,219,486 | 6/1993 | Ahmed et al. | 252/99 X |
| 5,229,026 | 7/1993 | Dixit | 252/174.24 X |
| 5,260,051 | 11/1993 | Cho | 252/174 X |
| 5,279,758 | 1/1994 | Choy | 252/174.14 X |
| 5,348,682 | 9/1994 | Finley et al. | 252/186.36 |
| 5,470,499 | 11/1995 | Choy et al. | 252/99 |

FOREIGN PATENT DOCUMENTS

| | | |
|---|---|---|
| 0345611 | 12/1989 | European Pat. Off. . |
| 03738614 | 6/1990 | European Pat. Off. . |
| 0446761 | 9/1991 | European Pat. Off. . |
| 479370 | 4/1992 | European Pat. Off. . |
| 0541203 | 5/1993 | European Pat. Off. . |
| 0560615 | 9/1993 | European Pat. Off. . |
| 606707 | 7/1994 | European Pat. Off. . |

OTHER PUBLICATIONS

"HyPure™ K Potassium Hypochlorite", *Olin Product Data*, Olin Corporation, 1991, one page.

"HyPure™ N Sodium Hypochlorite", *Olin Product Data*, Olin Corporation, 1991, one page.

*Primary Examiner*—Douglas J. McGinty

*Attorney, Agent, or Firm*—Joel J. Hayashida; Michael J. Mazza; Harry A. Pacini

[57] ABSTRACT

The invention provides a phase stable, thickened aqueous abrasive cleanser and a method for preparing it, said cleanser comprising:

a) an effective amount of a cross-linked polyacrylate;

b) an effective amount of at least one bleach-stable surfactant;

c) an effective amount of a low salt, high purity hypochlorite;

d) an effective amount of a pH-adjusting agent;

e) an effective amount of abrasive; and f) the remainder as water.

21 Claims, 2 Drawing Sheets

PHASE STABLE, THICKENED AQUEOUS ABRASIVE BLEACHING CLEANSER

This is a continuation of application Ser. No. 08/141,144, filed Oct. 22, 1993 now abandoned, which is a continuation-in-part of application Ser. No. 08/125,949, filed Sep. 23, 1993, now abandoned U.S. Pat. No. 5,470,499.

FIELD OF THE INVENTION

The present invention relates to thickened aqueous abrasive cleansers containing hypochlorite bleach with improved phase stability.

BACKGROUND OF THE INVENTION

Thickened hypochlorite bleach solutions or compositions have long been used in a variety of applications including hard surface cleaning, disinfecting and the like. These compositions are typically provided with increased viscosity for a number of reasons, principally to increase residence time of the composition on non-horizontal surfaces.

Many different examples of thickened hypochlorite bleach compositions have been available from a wide variety of sources for use in hard surface cleaning. For example, Finley et al., European Patent Application EP 373,864 and Prince et al., U.S. Pat. No. 5,130,043, disclosed hypochlorite bleach compositions consisting of polyacrylate thickeners, amine oxide detergent, and optional fatty acid soap and/or a bleach stable synthetic anionic detergent for cleaning hard surfaces such as toilet bowls, bathroom tiles and shower walls. However, both of these references do not disclose, teach, or suggest the need to reduce or limit the free electrolyte, or ionic strength, of thickened cleaners.

Other prior art references have also described various thickened automatic dish washing liquid compositions using polyacrylates in combination with colloidal thickeners to provide proper rheology and stability in hypochlorite bleach compositions including various adjuncts. Stoddart, U.S. Pat. No. 4,576,728, and Corring, U.S. Pat. No. 4,836,948, are representative of these other prior art references. These types of cleaners contain large amounts of builders, or other materials, which would boost the ionic strength of the resulting composition. Also, as automatic dish washing compositions (or, "ADWD's"), such cleaners typically must include silicates as overglaze protectors and contain relatively low amounts of surfactants, if at all, to prevent high foaming action.

Additionally, there are examples of hypochlorite-containing abrasive cleansers in the art, but they typically require either a colloidal clay thickener, such as disclosed in Hartman, U.S. Pat. Nos. 3,985,668, 4,005,027 and 4,051,056, a mixture of surfactants, such as disclosed in Jones et al., U.S. Pat. No. 4,352,678, or a stearate soap, such as disclosed in Chapman, U.S. Pat. No. 4,240,919. All of these systems suffer from disadvantages, such as premature hardening in the colloidal clay-thickened systems, or poor phase stability, as in the stearate-thickened systems.

Other examples of abrasive, hypochlorite-containing, thickened liquid cleansers with good physical stability include Choy et al., U.S. Pat. Nos. 4,599,186, 4,657,692 and 4,695,394, all of common assignment herewith.

A related application, Choy et al., U.S. patent application Ser. No. 08/125,949, filed Sep. 23, 1993, entitled "Thickened Aqueous Abrasive Cleanser With Improved Rinsability," commonly owned and assigned to The Clorox Company, discloses long-term phase and viscosity stable liquid abrasive cleansers, in which cross-linked polyacrylate, non-ionic surfactant, pH adjusting agent and calcium carbonate abrasive are combined. The disclosures of that application are incorporated herein by reference thereto.

Generally, these compositions have performed satisfactorily for their intended purpose. However, there is a need for thickened aqueous abrasive cleansers containing hypochlorite bleach with improved phase and bleach stability, offering improved characteristics and benefits.

SUMMARY OF THE INVENTION

In one aspect of the invention, the invention provides a phase stable, thickened aqueous abrasive cleanser comprising:

a) an effective amount of a cross-linked polyacrylate;

b) an effective amount of at least one bleach-stable surfactant;

c) an effective amount of a low salt, high purity hypochlorite;

d) an effective amount of a pH-adjusting agent;

e) an effective amount of particulate abrasive; and f) the remainder as water.

In another embodiment of the invention, the invention provides a method of preparing a phase stable, thickened aqueous abrasive cleanser comprising the steps of adding together:

a) water;

b) a low salt, high purity hypochlorite bleach;

c) an abrasive;

d) at least one bleach-stable surfactant; and e) a cross-linked polyacrylate, wherein, preferably, the polyacrylate is added as the last step.

In another preferred embodiment of the invention, the cleanser contains about 0.1–50% calcium carbonate abrasive. The formulations having a higher calcium carbonate content tend to have a plastic, creamy, flowable rheology, while those of lower calcium carbonate content (0.1–25%) will tend to have a shear-thinning rheology.

It is therefore an object of this invention to provide a hypochlorite bleach-containing thickened aqueous abrasive cleanser, without significant syneresis.

It is a further object of this invention to provide a hypochlorite bleach-containing thickened aqueous abrasive cleanser which has improved phase and viscosity stability.

It is a still further object of this invention to provide a hypochlorite bleach-containing thickened aqueous abrasive cleanser which has excellent chemical stability.

It is another object of this invention to provide a hypochlorite bleach-containing thickened aqueous abrasive cleanser in which improved thickening is achieved by coating the abrasive with a bleach-stable surfactant to shield the abrasive from cross-linked polyacrylate thickener.

It is yet another object of this invention to provide a hypochlorite bleach-containing thickened aqueous abrasive cleanser to improve the thickening of a polyacrylate-thickened rheology by the use of an amine oxide surfactant.

It is still another object of this invention to provide a bleach-containing thickened aqueous abrasive cleanser with a plastic rheology, which provides improved flow characteristics relative to non-polymer thickened cleansers, which frequently suffer from "bottle hangup," or a significant amount of residual product clinging to the container interior.

It is also an object of this invention to provide an improved method for preparing a bleach-containing thickened aqueous abrasive cleanser by adding a cross-linked polyacrylate thickener in the last step.

It is additionally an object of this invention to provide an improved method for preparing a bleach-containing thickened aqueous abrasive cleanser which has a lower abrasive content in order to enhance the cleanser's sheeting action on a vertical surface.

It is furthermore an object of this invention to provide a bleach-containing thickened aqueous abrasive cleanser which leaves no to minimal visible residue after rinsing from a surface.

It is additionally an object of this invention to provide a bleach-containing thickened aqueous abrasive cleanser which has entrained air to impart enhanced thickening and phase stability.

It is finally an object of this invention to provide a bleach-containing thickened aqueous abrasive cleanser with a calcium carbonate as the abrasive, at a content of about 0.1–25%, said cleanser having a shear-thinning rheology.

Figure 1:
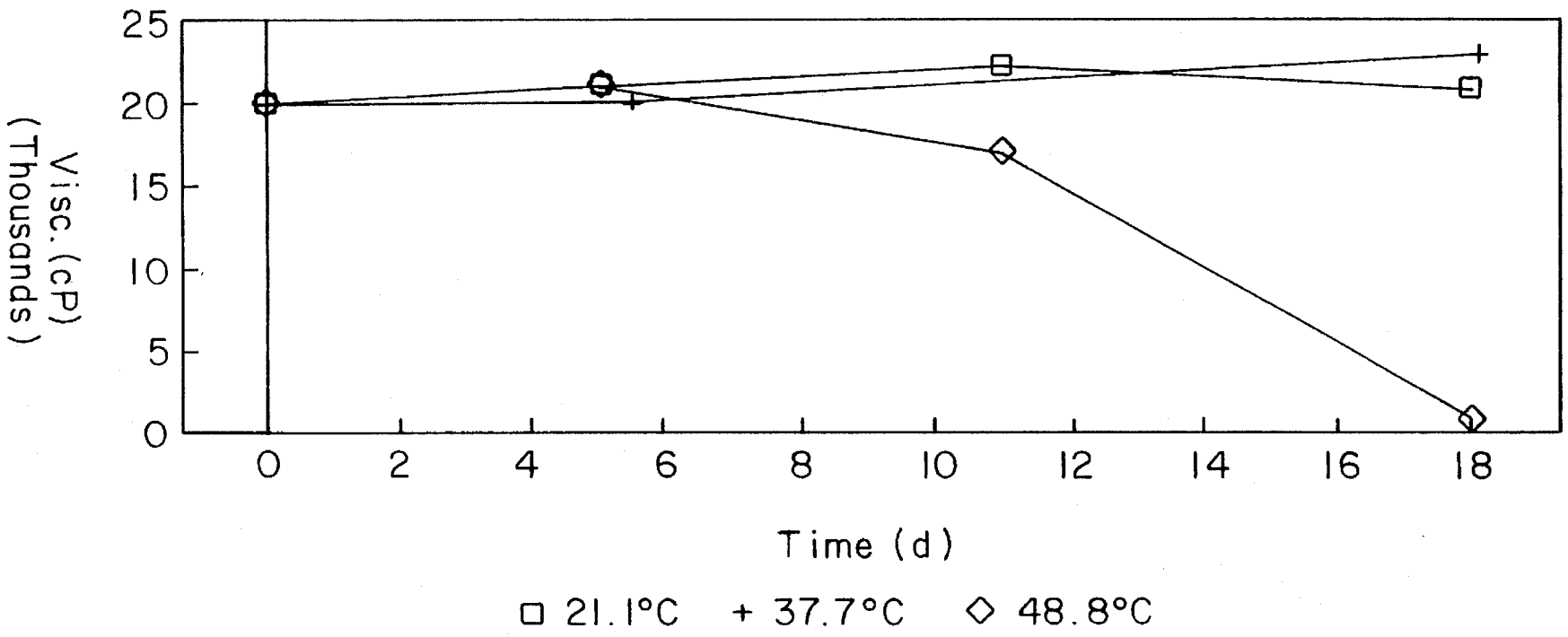
FIG. 1 is a graphical depiction of the viscosity stability of one of the preferred embodiments of this invention.

In each of the drawings, the viscosity, as measured in centipoise, with each unit representing 1,000, is plotted on the y axis, while the time in days is plotted on the x axis. Measurements at different temperatures are represented by a box (21.1° C.), cross-hatch (37.7° C.) and a diamond (48.8° C.).

DETAILED DESCRIPTION OF THE PREFERRED EMBODIMENTS

The invention provides a hard surface, hypochlorite-containing, abrasive scouring cleanser having no significant syneresis, undue viscosity or yield stress value increase, stably suspends abrasives, and has excellent rinsing characteristics. All of the foregoing advantages are present over time and after these compositions have been subjected to storage at elevated temperatures.

Furthermore, as compared to prior art cleaners which include high levels of mixed surfactants, the present invention provides a stably suspended abrasive scouring cleanser which uses relatively small amounts of surfactants, thus lowering the total cost of producing these cleansers. The absence of solvents results in a less irritating product as well.

In one embodiment, the invention provides a phase stable, thickened aqueous abrasive cleanser comprising:

a) an effective amount of a cross-linked polyacrylate;

b) an effective amount of at least one bleach-stable surfactant;

c) an effective amount of a low salt, high purity hypochlorite;

d) an effective amount of a pH-adjusting agent;

e) an effective amount of abrasive; and f) the remainder as water.

A further embodiment of the invention provides a method of preparing a phase stable, thickened aqueous abrasive cleanser comprising the steps of adding together:

a) water;

b) a low salt, high purity hypochlorite bleach;

c) an abrasive;

d) at least one bleach-stable surfactant;

e) a cross-linked polyacrylate, preferably, as the last step.

The individual constituents of the inventive cleansers are described more particularly below. As used herein, all percentages are weight percentages of actives, unless otherwise specified. Additionally, the term "effective amount" means an amount sufficient to accomplish the intended purpose, e.g., thickening, suspending, cleaning, etc.

Polyacrylate

The cross-linked polyacrylate polymers of the present invention are generally characterized as resins in the form of acrylic acid polymers. These resins are well known for use in a number of applications and it is commonly theorized that the carboxyl groups in the polymers are responsible for desirable characteristics resulting from the polymers.

Such cross-linked polyacrylate polymers are available from a number of sources including materials available under the trade name CARBOPOL® from B. F. Goodrich Company and under the trade name POLYGEL® available from 3V Chemical Company. Cross-linked polyacrylate polymers of a type contemplated by the present invention are also believed to be available from other sources which are also contemplated for use within the present invention and as defined herein.

The cross-linked polyacrylate polymers are generally characterized as acrylic acid polymers which are non-linear and water-dispersible while being cross-linked with an additional monomer or monomers in order to exhibit a molecular weight in the range from eighty thousand to about seven million g/mole, preferably about one hundred thousand to about seven million g/mole, more preferably about one million to seven million g/mole. Additionally, an average formula weight for a polymer subunit is about 60–120 g/mole, preferably 75–95 g/mole. The most preferred CARBOPOLs average about 86 g/mole. Preferably, the polymers are cross-linked with a polyalkenyl polyether, the cross-linking agents tending to interconnect linear strands of the polymers to form the resulting cross-linked product. The pH of an aqueous polymer solution provides a rough measure of the number of carboxyl groups in the polymer, and thus is an estimate of the degree of cross-linking and/or degree of branching of the polymer. Preferably, the pH of a 2% polymer solution at 21° C. should be between 1.8 and 5.0, more preferably 2.0 and 3.0. The pH is measured before neutralization.

Generally all cross-linked polyacrylate polymers are effective for achieving, in conjunction with the surfactant, the desired viscosity and stability compositions of the type contemplated by the present invention. However, some differences particularly in terms of stability have been observed for different cross-linked polyacrylate polymers. Suitable cross-linked polyacrylate polymers for purposes of the present invention include the CARBOPOL 600 series, 900 series, 1300 series and 1600 series resins Most. preferred are the CARBOPOL 1621 and 1610 resins (formerly known as 613 and 623 resins, respectively), which include a cross-linking agent plus hydrophobe. Also suitable is CARBOPOL 672 (formerly 614). More specific examples of polymers selected from these series are included in the examples set forth in the Experimental Section below. Similarly, effective cross-linked polyacrylate polymers for purposes of the present invention also include those available under the trade name POLYGEL and specified as DA, DB, and DK, available from 3V Chemical Company, and the SOKOLAN® polymers produced by the BASF Corporation.

As is also illustrated by the examples in the following Experimental Section, certain of the cross-linked polyacrylate polymers noted above may provide particular advantages or features within a thickened composition as contemplated by the present invention. Accordingly, it is also contemplated by the present invention to particularly employ mixtures or combinations of such polymers in order to produce compositions exhibiting combined characteristics of the respective polymers.

Generally, the cross-linked polyacrylate polymers of the present invention are believed to be tightly coiled in a presolvated condition with relatively limited thickening capabilities. Upon being dispersed in water, the polymer molecules are hydrated and uncoil or relax to varying degrees. Thickening is particularly effective with the polyacrylate polymers when they are uncoiled or relaxed as noted above. Uncoiling of the polyacrylate polymers may be achieved for example by neutralizing or stabilizing the polymer with inorganic bases such as sodium hydroxide, potassium hydroxide, ammonium hydroxide or low molecular weight amines and alkanolamines. Neutralization or stabilization of the polyacrylate polymers in this manner rapidly results in almost instantaneous thickening of an aqueous solution containing the polymers and surfactants. It is noted that the highest viscosity occurs when the polymer is completely neutralized; however, it has been empirically determined that elasticity is greater when the polymer is only partially neutralized. For some applications, it may be preferable to enhance elasticity rather than viscosity, for example, to aid in dispensing through restricted orifices, or to improve residence time on non-horizontal surfaces. Elasticity is also important to suspend abrasives, although even when fully neutralized the polymer retains sufficient elasticity for this purpose.

As noted above, the particular effectiveness of the cross-linked polyacrylate polymers in the present invention is believed to be due to a characteristic yield point or yield value. In this regard, it is noted that a typical liquid tends to deform as long as it is subjected to a tensile or shear stress of the type created by dispensing the liquid from a spray-type dispenser or the like. For such a liquid under shear, the rate of deformation or shear rate is generally proportional to the shear stress. This relationship was originally set forth in Newton's Law and a liquid exhibiting such proportional or straight-line characteristics are commonly termed Newtonian liquids.

With respect to thickening, it should be noted that while there are many types of inorganic and organic thickeners, not all will provide the proper type of shear-thinning rheology desired in the invention. Common clays, for instance, will likely lead to a false body rheology, which, at rest, turn very viscous. A thixotropic rheology is also not desirable in this invention since in the thixotropic state, a liquid at rest also thickens dramatically. If the thixotrope has a yield stress value, as typically found in clay-thickened liquid media, the fluid at rest may not re-achieve flowability without shaking or agitation. The surfactants included in the formulas of this invention are important in achieving the shear-thinning rheology. The formulations of this invention can develop viscosities in the range of 20–70,000 centipoise (cP), preferably 1,000–40,000 cP, and most preferably 10,000–30,000 cP. However, in an alternative embodiment containing a lower amount of abrasives, a viscosity of between about 4,000 to about 25,000, more preferably 5,000 to 15,000, is obtained.

Bleach-Stable Surfactants

The most preferred bleach-stable surfactants are the amine oxides, especially trialkyl amine oxides, as represented below.

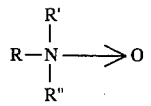

Additionally, it may be suitable to use mono-short chain $C_{1-4}$ alkyl, di-long chain $C_{10-20}$ alkyl amine oxides. In the structure above, R' and R" can be alkyl of 1 to 3 carbon atoms, and are most preferably methyl, and R is alkyl of about 10 to 20 carbon atoms. When R' and R" are both methyl and R is alkyl averaging about 12 carbon atoms, the structure for dimethyldodecylamine oxide, a preferred amine oxide, is obtained. Other preferred amine oxides include the $C_{14}$ alkyl (tetradecyl) and $C_{16}$ (hexadecyl) amine oxides. It is particularly preferred to use mixtures of any of the foregoing, especially a mixture of $C_{12}$ and $C_{16}$ dimethyl amine oxide. In general, it has been found that the longer alkyl group results in improved viscosity development, better stability, and reduced skin sensitivity, while the shorter alkyl group appears to contribute to better cleaning performance. Representative examples of these particular type of bleach-stable nonionic surfactants include the dimethyldodecylamine oxides sold under the trademarks AMMONYX® LO and CO by Stepan Chemical. Yet other preferred amine oxides are those sold under the trademark BARLOX® by Lonza, Conco XA sold by Continental Chemical Company, AROMAX™ sold by Akzo, and SCHERCAMOX™ sold by Scher Brothers, Inc. These amine oxides preferably have main alkyl chain groups averaging about 10 to 20 carbon atoms.

Betaines and their derivatives, especially $C_{10-20}$ betaines, may also be useful in the compositions of the invention. Particularly preferred are betaines such as those described in the previously mentioned Choy et al. references, the disclosures of which are incorporated herein by reference.

The polyacrylates of the present invention are highly branched and, as described previously, are relatively tightly coiled in a presolvated condition. When dispersed in water, the polymer molecules are hydrated and uncoil to some degree, providing some thickening. However, full viscosity development occurs only when the polymer is neutralized, creating a net negative charge on the carboxyl group. Owing to the proximity of the carboxyl groups, the negatives tend to repel each other, thus greatly increasing the volume occupied by the polymer and resulting in significant thickening. In any system where cations may be present, however, these cations may mitigate the electrostatic repulsion between adjacent anionic carboxyl groups or, in the case of divalent cations, may actually bridge the carboxyl groups, thus recoiling the polymer. Calcium is one such divalent cation which can create such a problem. The use of such cross-linked polyacrylate thickeners in the art has therefore been limited to compositions wherein high levels of calcium, for example calcium carbonate, were not present. It has now been surprisingly found that a polyacrylate can be used as a thickener even in a system containing high levels of a calcium carbonate abrasive by employing the identified surfactants. It is theorized that the surfactant affords viscosity stability to the polyacrylate by "surfactant shielding," that is, the positive pole of the surfactant is attracted to the negatively charged carboxyl groups of the polymer, thus shielding the carboxyl groups from positively charged species. It has been empirically determined that shielding-effective surfactants have a hydrophobic-lipophobic balance (HLB) of between about 11–13. Most preferred is an amine oxide. The surfactant is present in a shielding-effective amount, generally about 0.1 to 10% by weight, more preferably about 0.5 to 3% by weight.

Cosurfactants

A cosurfactant may be selected from anionic surfactants such as soaps (alkyl carboxylates), alkali metal alkyl sulfates, alkyl aryl sulfonates, primary and secondary alkane sulfonates (SAS, also referred to as paraffin sulfonates), alkyl diphenyl ether disulfonates, and mixtures thereof. These anionic surfactants will preferably have alkyl groups averaging about 8 to 20 carbon atoms. Most preferred are the soaps, especially potassium soaps. The soaps utilized are typically formed in situ, by using the appropriate carboxylic acid (e.g., a $C_{6-18}$ carboxylic acid, such as, without limitation, lauric, stearic, myristic acids, and unsaturated acids, such as coco fatty acid), and neutralizing with e.g., potassium hydroxide (KOH). Other alkali metal hydroxides, such as sodium hydroxides, can be utilized. Commercial sources of these fatty acids include Henkel KGaA's Emery Division. Further, alkali metal salts of alkyl aryl sulfonic acids might be useful, such as linear alkyl benzene sulfonates, known as LAS's. Typical LAS's have $C_{8-16}$ alkyl groups, examples of which include Stepan Chemical Company's BIOSOFI®, and CALSOFI® manufactured by Pilot Chemical Company. Still further potentially suitable cosurfactants include the alkyl diphenyl ether disulfonates, such as those sold by Dow Chemical Company under the name "Dowfax," e.g., Dowfax 3B2. Other potentially suitable anionic cosurfactants include alkali metal alkyl sulfates such as Conco Sulfate WR, sold by Continental Chemical Company, which has an alkyl group of about 16 carbon atoms; and secondary alkane sulfonates such as HOSTAPUR SAS, manufactured by Farbwerke Hoechst A. G., Frankfurt, Germany.

Determining an appropriate mixture of polyacrylate and surfactants is very important to the invention. While theoretically anywhere from about 0.01% to 5% polyacrylate can be used, and about 0.1 to 15% surfactants, so long as proper rheology and lack of phase separation or syneresis result, in practice it is preferred to use minimal quantities of polyacrylate and surfactants. The amount that is ordinarily used is an amount which is both abrasive-suspending and thickening-effective amount. Applicants have found that preferably about 0.1% to 3%, and most preferably about 0.1% to 1% of polyacrylate, and preferably about 0.25% to 5.0%, most preferably about 0.5% to 3.0% of total surfactant are used in the cleansers of this invention. These ranges appear to result in compositions having the desired syneresis values, ability to suspend abrasives, enhanced rinsability and, because of the reduced amount of actives in the compositions, lower overall manufacturing costs.

Stabilizing Agent

A stabilizing agent may be necessary to maintain viscosity and/or phase stability when certain anionic cosurfactants are present. Preferred stabilizing agents are hydrotropes, which are generally described as non-micelle-forming substances, either liquid or solids, organic or inorganic, capable of solubilizing insoluble compounds in a liquid medium. As with surfactants, it appears that hydrotropes must interact or associate with both hydrophobic and hydrophilic media. Unlike surfactants, typical hydrotropes do not appear to readily form micelles in aqueous media on their own. In the present invention, it is important that the hydrotrope act as a dispersant and not as a surfactant. In this regard, it is commonly observed that a hydrotrope is a dispersant which does not affect the critical micelle concentration ("CCMC") of the liquid system. As a dispersant, the hydrotrope acts to prevent micelle formation by any anionic surfactants present. Similarly, it should be noted that concentration or amount of the material, as well as type, may also be critical towards determining whether such material is a hydrotrope. Thus, materials which ordinarily are classified surfactants may in fact behave as hydrotropes if the amount used is limited.

The preferred hydrotropes are alkali metal salts of benzoic acid and its derivatives; alkyl sulfates and sulfonates with 6–10 carbons in the alkyl chain, $C_{8-14}$ dicarboxylic acids, anionic polymers such as polyacrylic acid and their derivatives; and most preferably, unsubstituted and substituted, especially the alkali metal salts of, aryl sulfonates; and unsubstituted and substituted aryl carboxylates. As used herein, aryl includes benzene, napthalene, xylene, toluene, cumene and similar aromatic nuclei. Further, "substituted" aryl means that one or more substituents known to those skilled in the art, e.g., halo (chloro, bromo, iodo, fluoro), nitro, or $C_{1-4}$ alkyl or alkoxy, can be present on the aromatic ring. Other good dispersants include other derivatives of aryl sulfonates, salts of phthalic acid and its derivatives and certain phosphate esters. Most preferred are alkyl naphthalene sulfonates (such as Petro 22 available from Petro Chemicals Company) and sodium xylene sulfonate (such as Stepanate X, available from Stepan Chemical Company. Also preferred as stabilizing agents are soaps, discussed above under cosurfactants. It is noted here, though, that especially soluble alkali metal soaps of a fatty acid, such as $C_{6-14}$ fatty acid soaps, may perform a stabilizing function. Especially preferred are sodium and potassium soaps of lauric and myristic acid. When present, sufficient stabilizing agent is added to stabilize, generally 0 to no more than 1% by weight, preferably about 0. 1 to 0.5 weight percent.

pH Adjusting Agent pH adjusting agents may be added to adjust the pH, and/or buffers may act to maintain pH. In this instance, alkaline pH is favored for purposes of both rheology and cleaning effectiveness. Additionally, if the cleanser includes a hypochlorite source, a high pH is important for maintaining hypochlorite stability. Examples of buffers include the alkali metal silicates, metasilicates, polysilicates, carbonates, hydroxides, and mixtures of the same. Control of pH may be necessary to maintain the stability of a halogen source and to avoid protonating the amine oxide. For the latter purpose, the pH should be maintained above the pKa of the amine oxide. Thus for the hexadecyl dimethyl amine oxide, the pH should be above about 6. Where the active halogen source is sodium hypochlorite, the pH is maintained above about pH 10.5, preferably above or about pH 12. Most preferred for this purpose are the alkali metal hydroxides, especially potassium hydroxide. The total amount of pH adjusting agent/buffer including that inherently present with bleach plus any added, can vary from about 0.1% to 5%, preferably from about 0.1–1.0%.

Hypochlorite Bleach

In this invention, it is important to use an alkali metal hypochlorite bleach which has a relatively low salt content.

In the invention, it has been found necessary to minimize or avoid the presence of salts, such as sodium chloride, which contribute to ionic strength within the compositions. The hypochlorite would thus preferably be selected or formed in a manner to avoid the presence of such undesirable salts. For example, hypochlorite bleaches are commonly formed by bubbling chlorine gas through liquid sodium hydroxide or corresponding metal hydroxide to result in formation of the corresponding hypochlorite. However, such reactions commonly result in formation of a salt such as sodium chloride.

The present invention thus preferably uses hypochlorites formed for example by reaction of hypochlorous acid with alkali metal hydroxide in order to produce the corresponding hypochlorite with water as the only substantial by-product. Hypochlorite bleach produced in this manner is referred to as "high purity, high strength" bleach, or also, as "low salt, high purity" bleach, and is available from a number of sources, for example Olin Corporation which produces hypochlorite bleach as a 30% solution in water. The resulting solution is then diluted to produce the hypochlorite composition of the present invention.

The hypochlorite may be formed with other alkaline metals as are well known to those skilled in the art. Although the term "hypochlorite" is employed herein, it is not intended to limit the invention only to the use of chloride compounds but is also intended to include other halides or halites, as discussed in greater detail below. Generally, the present invention preferably uses potassium hypochlorite and, somewhat less preferably, sodium hypochlorite, produced by the high strength bleach process. To be avoided or minimized is a hypochlorite of any alkali metal including a chloride salt of the corresponding alkali metal. Here again, hypohalites formed with similar alkaline metals are similarly to be minimized. Furthermore, it is especially desirable that the hypochlorite of the invention either avoids the inclusion of a chloride salt as noted above or includes such a chloride salt only within a range of up to about 5% by weight of the composition. As the hypochlorite component is increased from about 1% by weight of the composition, the chloride salt should be even further reduced since the chloride salt, particularly in the presence of the hypochlorite component, makes it difficult to achieve desirable thickening of the composition, or stability.

The hypochlorite and any salt present within the composition are also the principal source of ionic strength for the composition. The ionic strength of the composition has an effect on thickening, that is, if the percentage of salt as noted above is exceeded, it becomes difficult to achieve desirable thickening in the composition. Moreover, high ionic strength may be detrimental to the stability of the composition as it can cause collapse of the polymer structure. In summary, the ionic strength of the compositions of the present invention is maintained preferably less than about 5M, more preferably less than about 3M. It is to be noted, however, that control of ionic strength is an additional avenue by which viscosity and rheology can be controlled, if desired. In general, increasing ionic strength decreases viscosity, but also contributes to a more plastic, less shear-thinning theology, and reduces rinsability. The hypochlorite is preferably present in an amount ranging from about 0.1 weight percent to about 10 weight percent, more preferably about 0.2% to 5%, and most preferably about 0.5% to 3%.

Abrasives

Abrasives such as a perlite, silica sand may be used herein and various other insoluble, inorganic particulate abrasives are also possible, such as quartz, pumice, feldspar, tripoli and calcium phosphate. However, it is most preferred to use calcium carbonate (also known as "calcite").

Calcium carbonate used in this invention appears to have a dual role. On the one hand, it is an abrasive and thus is used in the invention to promote cleaning action by providing a scouring action when the cleansers of the invention are used on hard surfaces.

The abrasive can be present in amounts ranging from about 0.1% to 70% by weight of the compositions of this invention, preferably about 20–50% by weight. In an alternate embodiment, the abrasive—preferably, calcium carbonate—content will be from about 0.5 to about 25%, which results in a more fluid product, which has the ability to sheet and cling onto vertical surfaces. Particle size will range from average particle size of about ten to eight hundred, more preferably forty to six hundred, most preferably fifty to five hundred microns. In general, about 50% or more of the particles will have particle diameters of greater than one hundred microns (pass through U.S. 150 mesh sieves). Particle hardness of the abrasives can range from Mohs hardness of about 2–8, more preferably 3–6. Calcium carbonate, also known as calcite, is available from numerous commercial sources such as Georgia Marble Company, and has a Mobs hardness of about 3. Typically, a size of U.S. 140 mesh is selected, although others may be appropriate.

Abrasives can affect the viscosity of the formulations. It is known that there can be a "hard sphere" thickening phenomenon merely by the addition of insoluble materials into a liquid phase. In the systems of the invention, moreover, it appears that the abrasives help to thicken somewhat by compressing the polyacrylate polymer.

Figure 2:
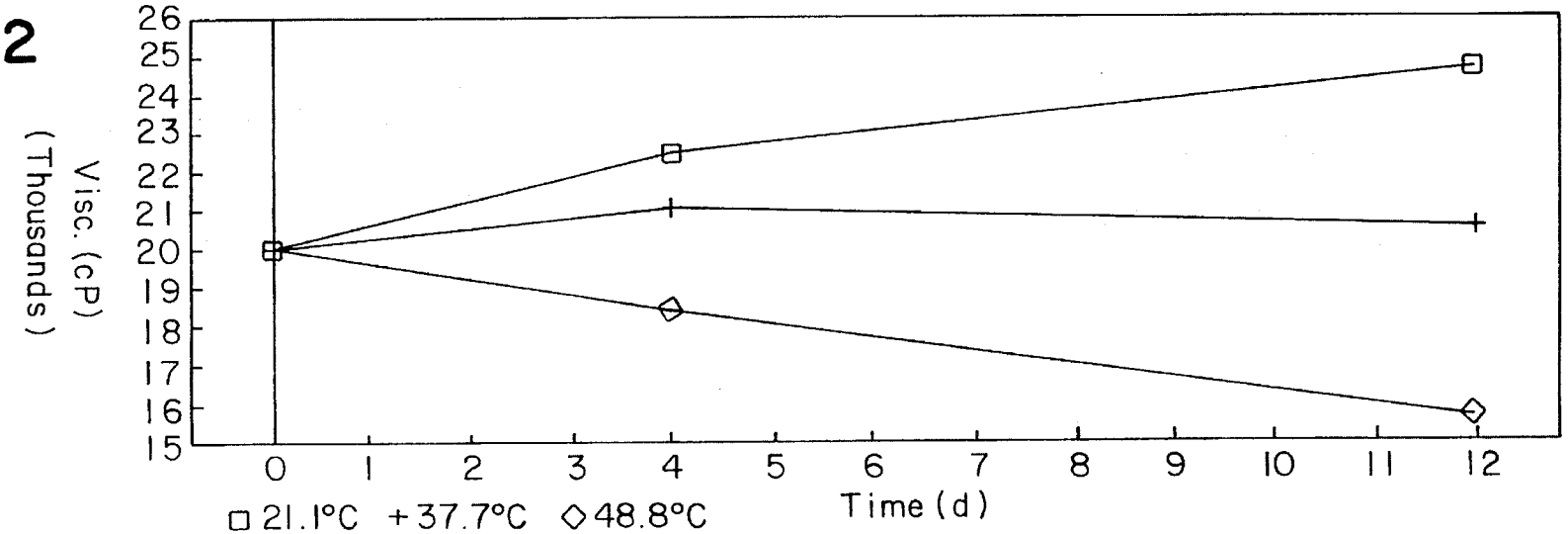
FIG. 2 is another graphical depiction of the viscosity stability of one of the preferred embodiments of this invention.
Figure 3:
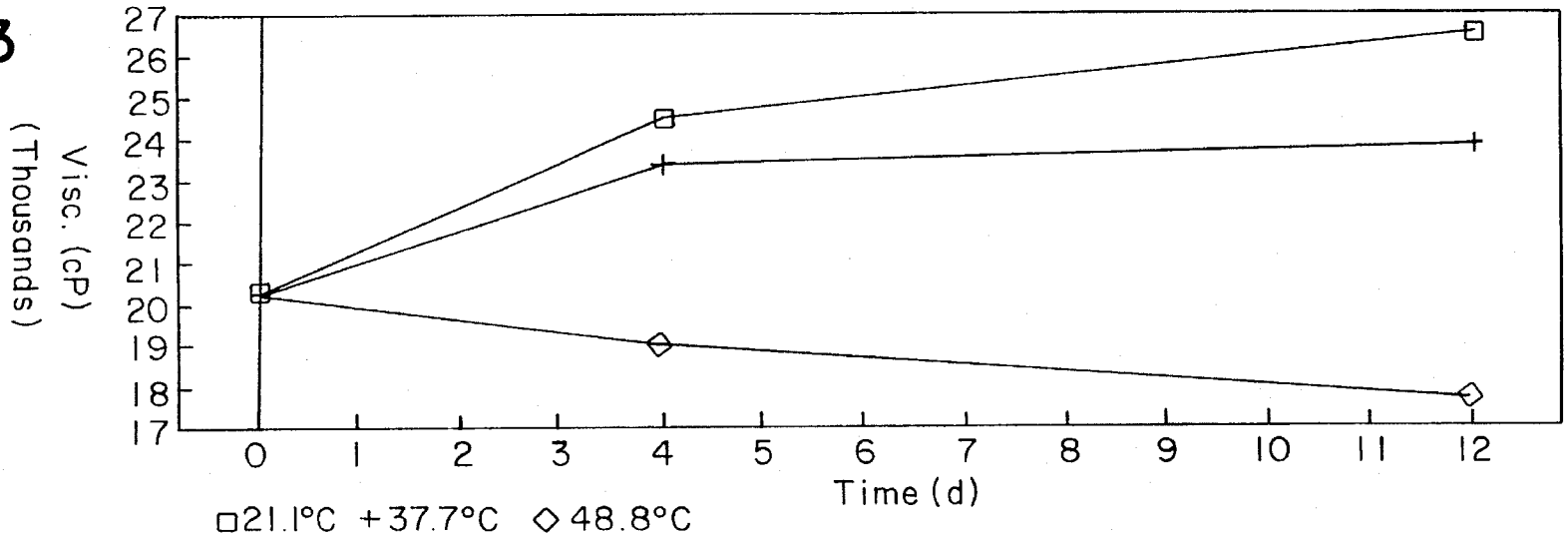
FIG. 3 is yet another graphical depiction of the viscosity stability of one of the preferred embodiments of this invention.

However, when calcium carbonate is used as the abrasive, it has an additional impact on thickening and suspension of actives in the compositions herein. There appears to be an interaction between soluble calcium—which arises from having calcium carbonate in aqueous dispersion—and the charged carboxylate groups of the cross-linked polyacrylate thickener. The presence of $CaCO_3$ thus may mediate cross-linking of the polymer, resulting in co-thickening. This can be seen especially at room temperature, for example, as depicted in the drawings, FIGS. 1–3. Thus, it is preferable in the production of these inventive cleansers to assure that the carbonate is added prior to the addition of the surfactants, especially the amine oxide. And it is additionally preferable to add the polyacrylate as the last step in the manufacture. By following this order of addition, the reaction of free calcium ions and the polyacrylate is essentially mitigated, apparently because the calcium carbonate particles have become coagulated by the surfactants. However, while it is preferred to add the polyacrylate as the last step, in fact, an alternate order of addition can be beneficial. For example, when calcium carbonate, or other porous abrasives, are added in the last step, the formulation becomes aerated, entraining air bubbles, thus resulting in enhanced thickening and stability.

Water

It should be briefly noted that the main ingredient in the inventive compositions is water, preferably water with minimal ionic strength. Water provides the continuous liquid phase into which the other ingredients are added to be dissolved/dispersed. This provides the unique fluid properties of the invention. The amount of water present generally exceeds 30% and, indeed, can be as high as 99%, although generally, it is present in a quantity sufficient (q.s.) to provide the appropriate fluid characteristics desired of the product.

Optional Ingredients

The composition of the present invention can be formulated to include such components as fragrances, coloring agents, whiteners, solvents, chelating agents and builders, which enhance performance, stability or aesthetic appeal of the composition. From about 0.01% to about 0.5% of a fragrance such as those commercially available from International Flavors and Fragrance, Inc. may be included in any of the compositions of the first, second or third embodiments. Dyes and pigments may be included in small amounts. Ultramarine Blue (UMB) and copper phthalocyanines are examples of widely used pigments which may be incorporated in the composition of the present invention. Buffer materials, e.g. carbonates, silicates and polyacrylates also may be added, although there is the caveat that amounts of such buffers should not be present so as to elevate the ionic strength of the compositions.

Additionally, certain less water soluble or dispersible organic solvents, some of which are advantageously hypochlorite bleach stable, may be included. These bleach stable solvents include those commonly used as constituents for proprietary fragrance blends, such as terpene derivatives. The terpene derivatives herein include terpene hydrocarbons with a functional group. Effective terpenes with a functional group include, but are not limited to, alcohols, ethers, esters, aldehydes and ketones. Representative examples for each of the above classes of terpenes with functional groups include but are not limited to the following: Terpene alcohols, including, for example, verbenol, transpinocarveol, cis-2-pinanol, nopol, iso-borneol, carbeol, piperitol, thymol, α-terpineol, terpinen-4-ol, menthol, 1,8-terpin, dihydro-terpineol, nerol, geraniol, linalool, citronellol, hydroxycitronellol, 3,7-dimethyl octanol, dihydromyrcenol, β-terpineol, tetrahydro-alloocimenol and perillalcohol; Terpene ethers and esters, including, for example, 1,8-cineole, 1,4-cineole, isobornyl methylether, rose pyran, α-terpinyl methyl ether, menthofuran, trans-anethole, methyl chavicol, allocimene diepoxide, limonene mono-epoxide, iso-bornyl acetate, nopyl acetate, α-terpinyl acetate, linalyl acetate, geranyl acetate, citronellyl acetate, dihydro-terpinyl acetate and neryl acetate; Terpene aldehydes and ketones, including, for example, myrtenal, campholenic aldehyde, perillaldehyde, citronellal, citral, hydroxy citronellal, camphor, verbenone, carvenone, dihyro-carvone, carvone, piperitone, menthone, geranyl acetone, pseudo-ionone, α-ionone, β-ionone, iso-pseudo-methyl ionone, normal-pseudo-methyl ionone, iso-methyl ionone and normal-methyl ionone.

Terpene hydrocarbons with functional groups which appear suitable for use in the present invention are discussed in substantially greater detail by Simonsen and Ross, *The Terpenes*, Volumes I–V, Cambridge University Press, 2nd Ed., 1947 (incorporated herein by reference thereto). See also, co-pending and commonly assigned U.S. patent application Ser. No. 07/780,360, filed Oct. 22, 1991, of Choy, incorporated herein by reference thereto.

Methods of Preparing

In one method for preparing the compositions of this invention, all of the ingredients are charged into an appropriate volume vessel and mixed. However, because large scale processing is sometimes facilitated by addition order, numerous methods of preparation were explored and tested herein.

There is another preferred addition order used to develop the desired viscosity and to enable the polyacrylate system to maintain the viscosity over time. In this preferred process water, pit adjusting agent, low ionic strength, high purity hypochlorite bleach, preferably, potassium hypochlorite, are added, along with the abrasive, typically, calcium carbonate are mixed in a suitable vessel, with stirring, and allowed to degas. Next, surfactants, such as the bleach-stable nonionic surfactant, and, if used, an anionic surfactant, are added. The polyacrylate is then added as an aqueous dispersion. Further thickening is observed. Adjuncts such as fragrances may be emulsified by the surfactant(s) and can be added either prior to, or after, polymer addition. Finally, mixing speed and duration may be adjusted as necessary to incorporate any adjuncts.

In yet another preferred process, all ingredients except for the abrasive, preferably, calcium carbonate, are combined. This will generally result in a gel, such as described in Garabedian et al. (U.S. patent application Ser. No. 08/097,738, filed Jul. 27, 1993, of common assignment herewith, and incorporated herein by reference thereto). Thereafter, the abrasive is charged directly into the gel and dispersed with good mixing. The gel breaks down, forming a somewhat lumpy dispersion, at first, then gradually resulting in an opaque, creamy, thickened liquid, wherein the abrasives are well suspended. Beneficially, since good mixing was used, aeration of the product occurs, resulting in entrained air bubbles, causing somewhat higher viscosity. This somewhat higher viscosity (above 25,000 cp) may have performance benefits for cleaning applications requiring a stiffer formulation.

The Experimental section below depicts various examples of the formulations of the invention, as well as empirical observations on their advantages.

Experimental

In Example I, a preferred formulation is set forth.

| Ingredient | Wt. % | Actives Wt. % |
|---|---|---|
| Preblend | | |
| KOCl (16.8%) | 7.47 | 1.25 |
| $H_2O$ (50% of total) | 13.00 | 12.66 |
| $CaCO_3$ | 30.00 | 29.22 |
| | 50.47 | 33.13 |
| Formulation | | |
| $H_2O$ (50% of total) | 13.00 | 12.66 |
| KOH (45% sol.) | 1.72 | .18 |
| Amine Oxide[1] (30%) | 1.24 | .37 |
| Soap Solution[2] (8.75%) | 5.6 | .49 |
| Preblend (from above) | 50.47 | 33.13 |
| Cross-linked polyacrylate[3] | 28.00 | .30 |
| Fragrance Oil | 0.04 | .04 |
| Remaining $H_2O$ | | q.s. |
| | 100.00% | |

[1]Barlox 12, from Lonza Chemical.
[2]Coco fatty acid soap.
[3]Carbopol 1610, from B.F. Goodrich.

In this Example I, the first four ingredients were added, resulting in a thin liquid. The potassium hypochlorite/calcium carbonate preblend was then added, with good mixing. Finally, the polyacrylate and the fragrance oil were added, resulting in good, controllable thickening. (It should again be noted that the fragrance oil can, optionally, be added with the surfactants.) The resulting product had a thick and creamy consistency. Using a Brookfield RVT Rotoviscometer, loaded with a #4 spindle, at 5 rpm, after 5 minutes of mixing, at 24.9° C., the resulting viscosity was 23,960 cp.

This Example I had excellent viscosity stability. The Table 1 below demonstrates the stability at room and elevated temperatures, and over an extended period.

TABLE 1

| Time | Temperature | Viscosity |
|---|---|---|
| Time 0 | 21.1° C. | 24,800 cp |
| | 48.8° C. | 24,800 cp |
| Time = 7 days | 21.1° C. | 25,720 cp |
| | 48.8° C. | 31,320 cp |

In the next Example II, a further preferred formulation was prepared.

| Ingredient | Wt. % | Actives Wt. % |
|---|---|---|
| D.I. $H_2O$ | 24.77 | q.s. |
| KOH | 1.22 | 0.55 |
| KOCl | 7.60 | 0.125 |
| $CaCO_3$ | 35.00 | 35.00 |
| Amine oxide[1] | 3.00 | 0.90 |
| Soap Solution[2] | 5.60 | 0.49 |
| Polyacrylate Dispersion[3] | 22.77 | 0.37 |
| Fragrance Oil | 0.04 | 0.04 |
| | 100.00% | |

[1]Barlox 1216, from Lonza Chemicals. In the Examples following, unless otherwise noted, the identification of the ingredients in these footnotes is the same.
[2]Lauryl soap solution, 8.75% actives, formed by neutralizing lauric acid in situ with KOH.
[3]Carbopol 1610, from B.F. Goodrich.

This Example II also had excellent viscosity stability. The Table 2 below demonstrates the stability at room and elevated temperatures, and over extended time periods.

TABLE 2

| Time | Temperature | Viscosity |
|---|---|---|
| Time 0 | 21.1° C. | 19,600 cp |
| Time = 7 days | 21.1° C. | 21,120 cp |
| | 37.7° C. | 21,240 cp |
| | 48.8° C. | 20,880 cp |
| Time = 12 days | 21.1° C. | 21,440 cp |
| | 37.7° C. | 20,440 cp |
| | 48.8° C. | 20,560 cp |

In the next Example III, a further preferred formulation was prepared. Example III

| Ingredient | Wt. % | Actives Wt. % |
|---|---|---|
| D.I. $H_2O$ | 23.85 | q.s. |
| KOH | 1.25 | 0.55 |
| KOCl | 7.60 | 0.125 |
| $CaCO_3$ | 35.00 | 35.00 |
| Amine oxide | 3.00 | 0.90 |
| Soap Solution | 5.60 | 0.49 |
| Polyacrylate Dispersion | 23.69 | 0.385 |
| Fragrance Oil | 0.04 | 0.04 |
| | 100.00% | |

This Example III additionally had excellent viscosity and syneresis stability, except for at the highest temperature over extended time. The Table 3 below demonstrates the viscosity stability at room and elevated temperatures, and over extended time periods. This is also graphically depicted in FIG. 1 of the Drawings. Table 4 demonstrates syneresis stability. (Syneresis was determined by metering the liquid formulations into clear, 16 fluid oz. bottles and measuring the height of the watery layer over the opaque, creamy liquid layer.)

TABLE 3

| Viscosity | | |
|---|---|---|
| Time | Temperature | Viscosity |
| Time 0 | 21.1° C. | 19,6000 cp |
| | 37.7° C. | 19,6000 cp |
| | 48.8° C. | 19,6000 cp |
| Time = 5 days | 21.1° C. | 21,160 cp |
| | 37.7° C. | 20,000 cp |
| | 48.8° C. | 20,920 cp |
| Time = 11 days | 21.1° C. | 22,240 cp |
| | 37.7° C. | 21,360 cp |
| | 48.8° C. | 17,000 cp |
| Time = 18 days | 21.1° C. | 20,720 cp |
| | 37.7° C. | 22,840 cp |
| | 48.8° C. | 520 cp |

TABLE 4

| Syneresis | | | |
|---|---|---|---|
| | Temperature | | |
| Time | 21.1° C. | 37.7° C. | 48.8° C. |
| 0 | 0% | 0% | 0% |
| 5 days | 0% | 0% | 0% |
| 11 days | 0% | 3% | 3% |
| 18 days | 0% | 3% | 30% |

In the next Example IV, a still further preferred formulation was prepared.

| Ingredient | Wt. % | Actives Wt. % |
|---|---|---|
| D.I. $H_2O$ | 23.85 | q.s. |
| KOH | 1.25 | 0.55 |
| KOCl | 7.60 | 0.125 |
| $CaCO_3$ | 35.00 | 35.00 |
| Amine oxide | 3.00 | 0.90 |
| Soap Solution | 5.60 | 0.49 |
| Polyacrylate Dispersion | 25.00 | 0.40 |
| Fragrance Oil | 0.04 | 0.04 |
| | 100.00% | |

This Example IV additionally had excellent viscosity and syneresis stability, even at the highest temperature over extended time. The Table 5 below demonstrates the viscosity stability at room and elevated temperatures, and over extended time periods. This is also graphically depicted in FIG. 2 of the Drawings. Table 6 demonstrates syneresis stability.

TABLE 5

| Viscosity | | |
|---|---|---|
| Time | Temperature | Viscosity |
| Time 0 | 21.1° C. | 20,000 cp |
| | 37.7° C. | 20,000 cp |
| | 48.8° C. | 20,000 cp |

TABLE 5-continued

| Viscosity | | |
|---|---|---|
| Time | Temperature | Viscosity |
| Time = 4 days | 21.1° C. | 22,240 cp |
| | 37.7° C. | 21,080 cp |
| | 48.8° C. | 18,400 cp |
| Time = 12 days | 21.1° C. | 24,680 cp |
| | 37.7° C. | 20,520 cp |
| | 48.8° C. | 15,580 cp |

TABLE 6

| Syneresis | | | |
|---|---|---|---|
| | Temperature | | |
| Time | 21.1° C. | 37.7° C. | 48.8° C. |
| 0 | 0% | 0% | 0% |
| 4 days | 0% | 0% | 0% |
| 12 days | 0% | 0% | 3% |

In the next Example V, a still further preferred formulation was prepared. As can be seen from the preceding examples II–IV, the amount of cross-linked polyacrylate is increased, resulting in increasing longterm viscosity and syneresis stability.

| Ingredient | Wt. % | Actives Wt. % |
|---|---|---|
| D.I. $H_2O$ | 23.85 | q.s. |
| KOH | 1.25 | 0.55 |
| KOCl | 7.60 | 0.125 |
| $CaCO_3$ | 35.00 | 35.00 |
| Amine oxide | 3.00 | 0.90 |
| Soap Solution | 5.60 | 0.49 |
| Polyacrylate Dispersion | 26.25 | 0.42 |
| Fragrance Oil | 0.04 | 0.04 |
| | 100.00% | |

This Example V additionally had excellent viscosity and syneresis stability, even at the highest temperature over extended time. The Table 7 below demonstrates the viscosity stability at room and elevated temperatures, and over extended time periods. This is also depicted graphically in FIG. 3 of the Drawings. Table 8 demonstrates syneresis stability.

TABLE 7

| Viscosity | | |
|---|---|---|
| Time | Temperature | Viscosity |
| Time 0 | 21.1° C. | 20,280 cp |
| | 37.7° C. | 20,280 cp |
| | 48.8° C. | 20,280 cp |
| Time = 4 days | 21.1° C. | 24,520 cp |
| | 37.7° C. | 23,400 cp |
| | 48.8° C. | 19,000 cp |
| Time = 12 days | 21.1° C. | 26,560 cp |
| | 37.7° C. | 23,880 cp |
| | 48.8° C. | 17,680 cp |

TABLE 8

| Syneresis | | | |
|---|---|---|---|
| | Temperature | | |
| Time | 21.1° C. | 37.7° C. | 48.8° C. |
| 0 | 0% | 0% | 0% |
| 4 days | 0% | 0% | 0% |
| 12 days | 0% | 0% | 3% |

In the next Example VI, a further embodiment of the invention is portrayed. In certain types of bathroom cleaners, it appears preferable to have a somewhat more flowable, or shear-thinning rheology, especially since these types of cleaners are intended to be applied to vertical, or curved surfaces, such as toilet bowls. While it is not quite certain whether these more flowable rheologies are actually shear-thinning (in fact, it is possible that these types of cleaners may merely have a longer relaxation time), the cleaner of Example VI has, in contrast to the preceding examples, a lower calcium carbonate content, and a higher cross-linked polyacrylate content. The resulting cleaner has, again, excellent viscosity and syneresis stability.

| Ingredient | Wt. % | Actives Wt. % |
|---|---|---|
| D.I. $H_2O$ | 43.84 | 86.43 |
| KOH (45%) | 1.72 | 0.77 |
| KOCl (16.5%) | 7.50 | 0.124 |
| $CaCO_3$ | 10.00 | 10.00 |
| Amine oxide[1] | 1.24 | 0.37 |
| Soap Solution[2] | 5.60 | 0.49 |
| Polyacrylate Dispersion[3] | 30.00 | 0.60 |
| Fragrance Oil | 0.1 | 0.1 |
| | 100.00% | |

[1]Ammonyx LO/CO (30% active), from Stepan Chemical.
[2]Coco fatty acid solution (8.75% active), neutralized with KOH.
[3]Carbopol 1610 solution (2% active).

This Example VI also had excellent viscosity and syneresis stability, even at the highest temperature over extended time. The Table 9 below demonstrates the viscosity stability at room and elevated temperatures, and over extended time periods. Table 10 demonstrates syneresis stability.

TABLE 9

| Viscosity | | |
|---|---|---|
| Time | Temperature | Viscosity |
| 1 week | 21.1° C. | 10,400 cp |
| | 37.7° C. | 11,000 cp |
| | 48.8° C. | 10,000 cp |
| 2 weeks | 21.1° C. | 10,300 cp |
| | 37.7° C. | 11,800 cp |
| | 48.8° C. | 10,400 cp |
| 3 weeks | 21.1° C. | 10,400 cp |
| | 37.7° C. | 11,600 cp |
| | 48.8° C. | 10,300 cp |
| 4 weeks | 21.1° C. | N/A |
| | 37.7° C. | 11,200 cp |
| | 48.8° C. | 6,200 cp |

TABLE 10

| | Syneresis | | |
|---|---|---|---|
| | Temperature | | |
| Time | 21.1° C. | 37.7° C. | 48.8° C. |
| 1 week | trace | slight trace | N/A |
| 2 weeks | 2.25% | ~1% | 1.4% |
| 3 weeks | 2.7% | 2.0% | 2.0% |
| 4 weeks | 4.2% | 2.0% | N/A |

The above examples have been depicted solely for purposes of exemplification and are not intended to restrict the scope or embodiments of the invention. The invention is further illustrated with reference to the claims which follow hereto.

We claim:

1. A phase stable, thickened aqueous abrasive cleanser having an ionic strength less than about 5M, said cleanser consisting essentially of a) 0.1–5% of a cross-linked polyacrylate;

b) 0.1–10% of at least one bleach-stable surfactant;

c) 0.1–10% of a low salt, high purity potassium hypochlorite;

d) 0.1–5% of a pH-adjusting agent;

e) 0.1–70% of abrasive; and f) the remainder as water.

2. The phase stable, thickened aqueous abrasive cleanser of claim 1 wherein said bleach-stable surfactant is selected from anionic, amphoteric, nonionic bleach stable surfactants, and mixtures thereof.

3. The phase stable, thickened aqueous abrasive cleanser of claim 2 wherein said surfactant is a nonionic surfactant.

4. The phase stable, thickened aqueous abrasive cleanser of claim 3 wherein said surfactant is a trialkyl amine oxide.

5. The phase stable, thickened aqueous abrasive cleanser of claim 4 additionally comprising a fatty acid.

6. The phase stable, thickened aqueous abrasive cleanser of claim 5 wherein said fatty acid is neutralized in situ.

7. The phase stable, thickened aqueous abrasive cleanser of claim 4 wherein said trialkyl amine oxide is a $C_{10-20}$ monoalkyl, $C_{1-4}$ dialkyl, amine oxide.

8. The phase stable, thickened aqueous abrasive cleanser of claim 1 wherein said pH adjusting agent of (d) is an alkali metal hydroxide and said abrasive of (e) is calcium carbonate.

9. A method of preparing a phase stable, thickened aqueous abrasive cleanser having an ionic strength less than about 5M, said method consisting essentially of adding together:

a) water;

b) 0.1–5% of a pH-adjusting agent;

c) 0.1–10% of a low salt, high purity potassium hypochlorite bleach;

d) 0.1–10% of abrasives;

e) 0.1–10% of at least one bleach-stable surfactant; and f) 0.1–5% of a cross-linked polyacrylate.

10. The phase stable, thickened aqueous abrasive cleanser of claim 1 wherein the viscosity is about 5,000 to about 50,000.

11. The phase stable, thickened aqueous abrasive cleanser of claim 1 wherein the viscosity is about 4,000 to about 25,000.

12. The phase stable, thickened aqueous abrasive cleanser of claim 1 wherein the cleanser includes entrained air bubbles.

13. The method of claim 9 wherein the cleanser is aerated during the preparing of said abrasive cleanser.

14. The method of claim 9 wherein the bleach-stable surfactant is selected from anionic, amphoteric, nonionic bleach stable surfactants, and mixtures thereof.

15. The method of claim 14 wherein said surfactant is a nonionic surfactant.

16. The method of claim 15 wherein said surfactant is a trialkyl amine oxide.

17. The method of claim 16 additionally comprising a fatty acid.

18. The method of claim 17 wherein said fatty acid is neutralized in situ.

19. The method of claim 16 wherein said trialkyl amine oxide is a $C_{10-20}$ monoalkyl, $C_{1-4}$ dialkyl, amine oxide.

20. The method of claim 9 wherein said abrasive is calcium carbonate.

21. The method of claim 9 further comprising adding the cross-linked polyacrylate at the last in the order of addition of ingredients during the preparing of said abrasive cleanser.

* * * * *